United States Patent [19]

Farnia

[11] 4,445,461

[45] May 1, 1984

[54] WASTE HEAT RECOVERY METHOD AND APPARATUS

[75] Inventor: Khosrow Farnia, Brookfield, Wis.

[73] Assignee: Allis-Chalmers Corporation, Milwaukee, Wis.

[21] Appl. No.: 387,932

[22] Filed: Jun. 14, 1982

[51] Int. Cl.[3] ..... F22D 1/00

[52] U.S. Cl. ..... 122/7 R; 122/420

[58] Field of Search ..... 122/7 R, 420; 60/39.181; 48/210

[56] References Cited

U.S. PATENT DOCUMENTS

| | | | |
|---|---|---|---|
| 3,314,231 | 4/1967 | Hochmuth | 60/39.181 |
| 3,580,718 | 5/1971 | Rasworschegg et al. | 75/60 |
| 4,233,137 | 11/1980 | Ozaki et al. | 48/197 X |

*Primary Examiner*—Edward G. Favors

*Attorney, Agent, or Firm*—Timothy R. Conrad

[57] ABSTRACT

An apparatus and method are disclosed for the recovery of sensible heat from a hot tar-free gas produced in a coal gasification process and in combined-cycle power generation. The recovered heat is utilized to generate a flow of superheated steam which may be used in the gasification plant. The apparatus includes a first boiler and a superheater fabricated from materials susceptible to damage from thermal shock when a flow of the tar-free gas having a temperature in excess of a predetermined safety temperature is introduced to the superheater when it is dry. The first boiler, filled with a flow of saturated water, initially receives the flow of gas. Within the first boiler, the gas indirectly heats the water converting it to a flow of saturated steam and reducing the gas temperature below the safety temperature. The reduced temperature gas is passed to the superheater and the saturated steam is passed to the superheater. The gas heats the saturated steam in the superheater to convert it to superheated steam and the temperature of the gas is further reduced. The gas flows to a second boiler for converting a flow of saturated water to saturated steam and further reducing the gas temperature. The saturated steam from the second boiler is passed to the superheater and the gas flows to an economizer for converting a flow of unsaturated water to saturated water for the boilers and reducing the temperature of the gas to a final temperature.

9 Claims, 1 Drawing Figure

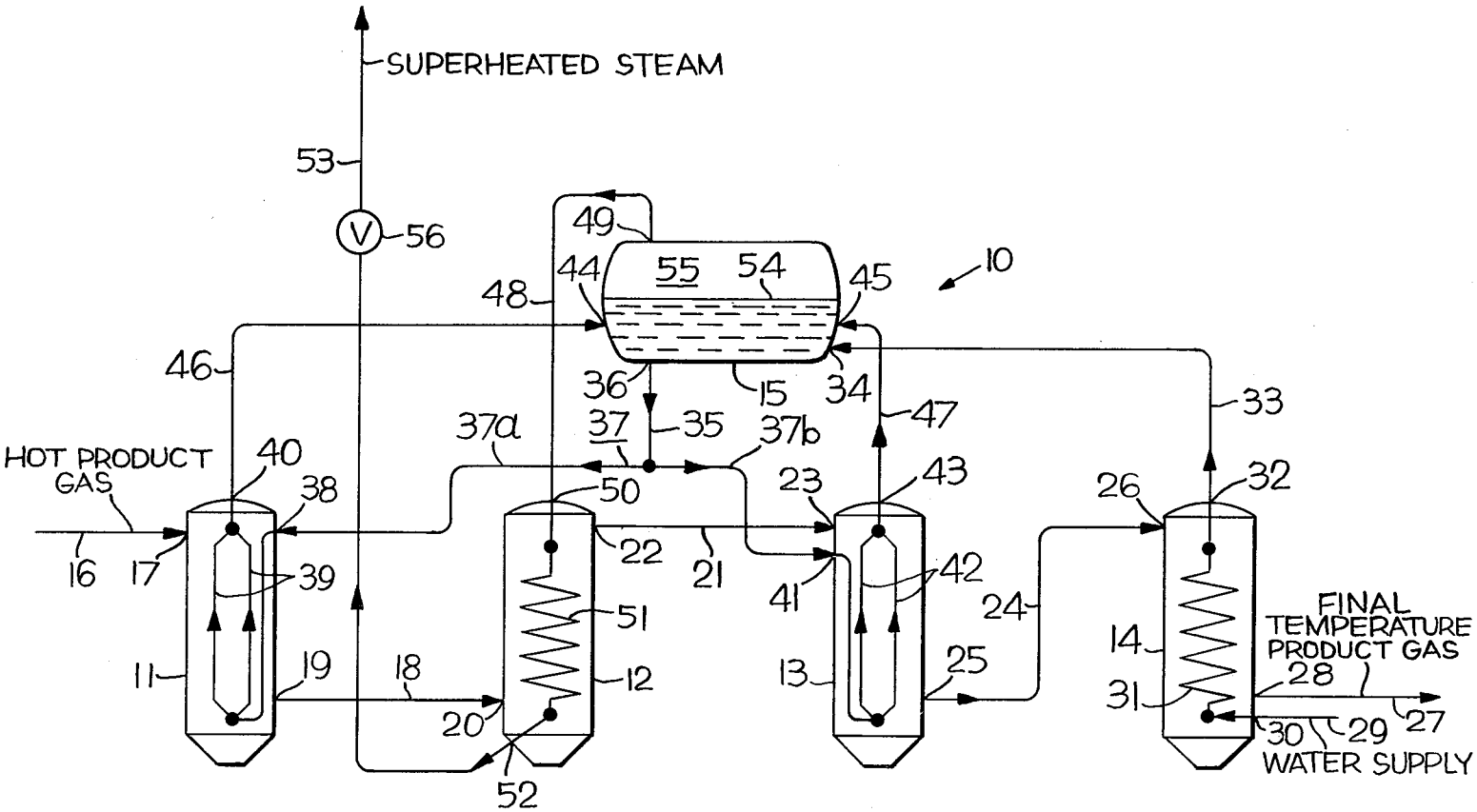
FINAL TEMPERATURE PRODUCT GAS
WATER SUPPLY
SUPERHEATED STEAM
HOT PRODUCT GAS
10
11
12
13
14
15
16
17
18
19
20
21
22
23
24
25
26
27
28
29
30
31
32
33
34
35
36
37
37a
37b
38
39
40
41
42
43
44
45
46
47
48
49
50
51
52
53
54
55
56

WASTE HEAT RECOVERY METHOD AND APPARATUS

BACKGROUND OF THE INVENTION

1. Field of the Invention

This invention relates to a method and apparatus for the recovery of heat from a hot gas flow. More particularly, this invention relates to a process for the recovery of heat from a flow of hot product gas produced in a coal gasification plant wherein the recovered heat is used to produce a flow of superheated steam which may be used in the gasification plant.

2. Description of the Prior Art

Copending U.S. patent application of P. G. Garside, Ser. No. 264,479 filed May 18, 1981, discloses a process for the production of a combustible product gas from coal in a rotary kiln gasifier. As disclosed in the aforesaid application, the gasifier generates two flows of a product gas. A first flow consists of product gas laden with vaporized tars and particulate matter. A second flow consists of product gas free of vaporized tars and containing only particulate material. The aforesaid application discloses the second flow of product gas, which is hotter than the first flow, is regulated to maintain the temperature of the first flow sufficiently high to prevent condensation of the tars within the first flow. Accordingly, in a coal gasification process as described, the second flow containing tar-free gas may, at times, be completely diverted to maintain the desired temperature of the first flow. At other times, when the entire second flow is not diverted, the remainder of the second flow is processed to remove the particulate matter.

In a process as described in the Garside application, it is economically advantageous to recover the sensible heat from the second flow after particulate removal. For example, the recovered heat can be used to produce a source of superheated steam which may be used in the gasification process as described in the aforesaid application or used in a steam turbine to generate electricity in a combined-cycle power plant.

In the prior art, heat exchanger systems for utilizing the heat of hot gases to produce steam are well known. Such conventional systems typically pass the hot gas through a superheater for indirectly heating a flow of saturated steam to convert the saturated steam to superheated steam. Saturated steam is steam which, for a given pressure, is at a temperature such that any reduction in the temperature results in water condensing within the steam. Superheated steam is steam which, for a given pressure, is at a temperature such that the temperature of the steam may be reduced a substantial amount before any water condenses.

In the conventional heat exchanger system, the temperature of the hot gas is reduced by reason of the heat transfer within the superheater. The reduced temperature gas is passed to a boiler for heating saturated water to generate saturated steam at a prescribed pressure and yet further reduce the temperature of the gas. The saturated steam produced in the boiler becomes the source of saturated steam for the superheater. Saturated water is water which, for a given pressure, is at a temperature (called the saturation temperature) such that any additional transfer of heat to the water will convert the water to steam rather than further increasing the temperature of the water. Unsaturated water is water which, for a given pressure, is at a temperature less than the saturation temperature.

Conventional steam generating systems, as described above, present significant problems in applications for heat recovery in gasification processes such as disclosed in the aforesaid application of P. G. Garside. As mentioned, the tar-free second gas flow, from which sensible heat is to be recovered, may be flowing intermittently. As a result of the intermittent nature of the flow, the superheater may, at times when no gases are passing through the system, become empty and dry. Subsequently, a flow of hot product gas (which may be of a temperature in excess of 1,800° F.) is admitted to the dry superheater. The sudden introduction of hot gas to the dry superheater presents a potentially dangerous situation since the temperature differential between the gas and the dry superheater creates a thermal shock which may damage the superheater. For superheaters fabricated from conventional material, such as carbon or stainless steel, a gas temperature in excess of a safety temperature, such as 1,100° F. to 1,300° F., presents a substantial risk of damage due to thermal shock when the gas is introduced to the dry superheater.

Two solutions have been suggested to resolve the above-mentioned problem. The first is to fabricate the superheater of special alloys, such as Incoloy and Inconel alloys, which can withstand the extreme thermal shock. However, such alloys are very expensive and such an approach is not an economical alternative for many applications.

A second solution is to provide the heat recovery system with an auxiliary boiler with a conventional furnace for producing saturated steam which is fed to the superheater prior to introducing the product gas to the superheater. Again, such a solution is very expensive since it requires auxiliary equipment.

SUMMARY OF THE INVENTION

It is an object of the present invention to provide a method and apparatus for the recovery of heat from a hot flow of gas by utilizing the heat of the gas to generate superheated steam in a superheater.

It is a further object of the present invention to provide a method and apparatus for the recovery of heat from a hot gas flow by utilizing the heat of the gas to generate superheated steam in a superheater while avoiding damage to the superheater caused by thermal shocks when the gas is introduced to the superheater when the superheater is dry.

It is yet a further object of the present invention to provide a method and apparatus for the recovery of heat from a flow of a tar-free product gas produced in a coal gasification process by utilizing the heat of the product gas to generate superheated steam, which may be used in the gasification process or a combined-cycle power generation process, in a superheater while avoiding damage to the superheater caused by thermal shocks when the gas is introduced to the superheater when the superheater is dry.

According to a preferred embodiment of the present invention, the above objects are achieved by providing a heat recovery system comprising a first boiler, a superheater, a second boiler, and an economizer to sequentially recover the sensible heat from a flow of a tar-free product gas produced in a coal gasification process. The superheater is fabricated from conventional materials, such as carbon or stainless steel, which have a predetermined safety temperature (e.g. 1,300° F.)

for which gases having temperatures in excess of the safety temperature would present a danger of damage of the superheater due to thermal shock when the gases are introduced to a dry superheater.

The heat recovery system includes a steam drum which is maintained with a level of water. The drum supplies a flow of water to the first and second boilers to maintain a level of water within each boiler at all times including when no product gases are flowing through the system. A flow of water is maintained to the economizer to provide a level of water within the economizer at all times including when no gases are flowing through the system.

A flow of hot product gas having a temperature in excess of the safety temperature is introduced to the first boiler. The hot gas heats the water within the first boiler converting the water to saturated steam and reducing the temperature of the gas to a secondary temperature below the safety temperature yet higher than a temperature necessary to convert saturated steam to superheated steam in a superheater. The saturated steam flows to the steam drum where it is dried and accumulates within the drum above the layer of saturated water within the drum.

The secondary temperature gas flows to the dry superheater and, due to its reduced temperature, flows through the superheater without creating damaging thermal shock within the superheater. The gas flows from the superheater to the second boiler and heats water within the boiler converting the water to saturated steam to generate the balance of steam required for subsequent use. The saturated steam flows from the second boiler to the steam drum where it is dried and accumulates within the drum.

The gas, its temperature further reduced in the second boiler, flows to the economizer and heats the water within the economizer converting the water to saturated water and further reduces the temperature of the gas to a final temperature.

Saturated steam accumulating within the steam drum flows to the superheater. Secondary temperature gas flowing from the first boiler into the superheater heats the saturated steam converting it to superheated steam and reducing the temperature of the gas to a temperature not lower than the temperature necessary to convert saturated water into saturated steam in the second boiler. When the superheater steam achieves a prescribed pressure, a control valve permits steam to flow for subsequent utilization.

BRIEF DESCRIPTION OF THE DRAWING

The drawing, consisting of a single FIGURE, is a schematic showing of a heat exchanger apparatus for the recovery of sensible heat from a flow of hot gas.

DESCRIPTION OF THE PREFERRED EMBODIMENT

Referring to the drawing, a heat exchanger apparatus 10 is shown for the recovery of sensible heat from a stream of a tar-free product gas as may be produced in a coal gasification process as disclosed in the aforesaid copending patent application of P. G. Garside. The apparatus 10 includes a first boiler 11, a superheater 12, a second boiler 13, an economizer 14 and a steam drum 15. It will be appreciated that boilers, superheaters, economizers and steam drums are all commercially available items, available in a wide variety of design, capacity and size, and they form no part of this invention per se. A more thorough explanation of the design and function of boilers, superheaters, economizers and steam drums may be found in *Kent's Mechanical Engineers' Handbook,* 12th Ed. Vol. Power, J. Kenneth Salisbury, Editor (1950). Additionally, superheater 11 is preferably fabricated from conventional materials, such as carbon or stainless steel. Such superheaters are susceptible to damage when the temperature of hot process gas admitted to the superheater, at times when the superheater is dry, exceeds a predetermined safety temperature. The safety temperature is generally within a range of 1,100° F. to 1,300° F. For convenience, the safety temperature will also be referred to as the safety temperature of the superheater.

A product gas supply conduit 16 is provided for supplying a flow of the tar-free product gas to a gas inlet 17 of first boiler 11. A first gas transfer conduit 18 is provided for transferring product gas from a gas outlet 19 of boiler 11 to a gas inlet 20 of superheater 12. A second gas transfer conduit 21 is provided for transferring product gas from a gas outlet 22 of superheater 12 to a gas inlet 23 of second boiler 13. A third gas transfer conduit 24 transfers gas from a gas outlet 25 of boiler 13 to a gas inlet 26 of economizer 14. A gas exhaust line 27 is provided for transfer gas from a gas outlet 28 of economizer to apparatus (not shown) for further treatment (such as sulfide removal).

A water supply conduit 29 is provided for delivering a supply of water from a source (not shown) to a water inlet 30 of economizer 14. A heat transfer coil 31 within economizer 14 connects inlet 30 in fluid flow communication with a water outlet 32. A first water transfer conduit 33 is provided connecting water outlet 32 in fluid flow communication with a water inlet 34 of steam drum 15. A second water transfer conduit 35 connects a water outlet 36 of steam drum 15 with a water distribution conduit 37 operable to divide a flow of water received from conduit 35 into a first distribution conduit **37*a* and a second distribution conduit 37*b***.

First distribution conduit **37*a* is connected in fluid flow communication with a water inlet 38 of first boiler 11. First boiler 11 is provided with a plurality of heat transfer pipes 39 connecting water inlet 38 in fluid flow communication with a steam outlet 40. Second distribution conduit 37*b* is connected in fluid flow communication with a water inlet 41 of second boiler 13. Second boiler 13 is provided with a plurality of heat transfer pipes 42 connecting water inlet 41 in fluid flow communication with a steam outlet 43**.

A first steam transfer conduit 46 is provided connecting steam outlet 40 of first boiler 11 in fluid flow communication with a first steam inlet 44 of the steam drum 15. A second steam transfer conduit 47 is provided connecting steam outlet 43 of second boiler 13 in fluid flow communication with a second steam inlet 45 of steam drum 15.

A steam distribution conduit 48 connects a steam outlet 49 of steam drum 15 in fluid flow communication with a steam inlet 50 of superheater 12. A heat transfer coil 51 within superheater 12 connects steam inlet 50 in fluid flow communication with a steam outlet 52. A steam exhaust line 53 is provided for transfer of superheated steam from steam outlet 52 to a distribution system (not shown) for distributing superheated steam for use (such as process steam in the gasification process as disclosed in the aforementioned patent application of P. G. Garside or for use in a combined-cycle power generating plant). A valve 56 is provided for permitting passage of superheated steam from superheater 12 through line 53 only when the steam achieves a prescribed pressure (e.g. 150 psig) required for the intended use of the steam.

METHOD OF THE INVENTION

In the operation of the heat exchanger apparatus 10, steam drum 15 is maintained with a supply of hot water with the water assuming a level 54 within drum 15. Additionally, at the initiation of operation of heat exchanger 10, conduits 35, 37*a* and 37*b*, heat transfer pipes 39 of first boiler 11, heat transfer pipes 42 of second boiler 13, and heat transfer pipes 31 of economizer 14 are filled with a supply of hot water of a temperature of approximately 250° F. At the initiation of operation, heat transfer coils 51 within superheater 12 are dry.

A flow of hot product gas is provided to first boiler 11 through product gas supply conduit 16 at a temperature higher than the safety temperature of the dry superheater 12. As the gas flows from inlet 17 to outlet 19 of boiler 11, the hot gas indirectly heats the hot water within heat transfer pipes 39 at a rate sufficient to convert the water to saturated steam and reduce the temperature of the gas. Boiler 11 is selected so that the temperature of the gas exiting outlet 19 is of a temperature lower than the safety temperature of superheater 12 and higher than the temperature necessary to convert saturated steam to superheated steam. The saturated steam produced in boiler 11 flows to the steam drum 15 through conduit 46. The reduced temperature gas flows from boiler 11 through conduit 18 to the superheater 12.

The initial flow of gas admitted to superheater 12 flows from inlet 20 to outlet 22 with little or no heat loss since superheater 12 is dry at the initiation of operation. Since the gas temperature has been reduced below the safety temperature, the dry superheater 12 is not subjected to potentially damaging thermal shocks. The gas flows from outlet 22 to the second boiler 13 through conduit 21. As the gas flows from inlet 23 to outlet 26 of boiler 13, the gas indirectly heats the hot water within the heat transfer pipes 42 at a rate sufficient to convert the saturated water to saturated steam and further reducing the temperature of the gas. Boiler 13 is selected so the temperature of the gas exiting outlet 26 is of a temperature sufficient to convert unsaturated water to saturated water within economizer 14. The saturated steam produced in boiler 13 flows to steam drum 15 through conduit 47. The further reduced temperature gas flows from boiler 13 to economizer 14 through conduit 24.

As the gas flows from inlet 26 to outlet 28 of economizer 14, it indirectly heats water within coil 31 at a rate sufficient to convert the unsaturated water to saturated water and yet further reducing the temperature of the gas to a final temperature. The final temperature gas flows from economizer 14 through exhaust conduit 27 to further apparatus (not shown) for further processing (such as sulfide removal). The saturated water produced in economizer 14 flows through conduit 33 to steam drum 15 to maintain a level 54 of saturated water within drum 15.

After initial operation, saturated water flows from drum 15 through conduits 35 and 37 to replenish the supply of saturated water within heat transfer tubes 39 and 42 of first boiler 11 and second boiler 13 respectively. The hot gas flowing through boilers 11 and 13 now converts the saturated water to saturated steam.

The steam admitted to drum 15 from conduits 46 and 47 is wet (that is, it is laden with entrained saturated water with dry steam accounting for approximately 10% by weight). Within the drum 15, the saturated water separates from the steam with dry saturated steam occupying a volume 55 of drum 15 above water level 54. The dry steam passes through conduit 48 to superheater 12 and into the heat transfer coil 51. Hot gas flowing from inlet 20 to outlet 22 within superheater 12 not indirectly heats the saturated steam within coil 51 converting it to superheated steam and reducing the temperature of the gas. Superheater 12 is selected so the temperature of the gas exiting outlet 22 is sufficient to convert saturated water to saturated steam in second boiler 13.

The gas flows from superheater 12 to boiler 13 and indirectly heats the saturated water therein to convert the water to saturated steam. The gas flowing to boiler 13 after heat exchange in superheater 12 is of a lower temperature than the gas initially transferred to boiler 13 when the superheater was dry. Accordingly, the efficiency of boiler 13 is reduced. That is, while the temperature of the gas exiting boiler 13 is unchanged, the rate at which saturated steam is generated in boiler 13 is reduced.

The superheater steam generated in superheater 12 flows from steam outlet 52 through steam exhaust conduit 53. Valve 56 prevents steam from passing until the steam achieves the prescribed pressure of 150 psig. When the steam pressure achieves 150 psig, valve 56 permits the steam to pass through conduit 53 to distribution apparatus (not shown) for supplying the superheated steam for the gasification plant.

In the operation of the apparatus 10 in a preferred embodiment for the recovery of sensible heat from a flow of hot tar-free product gas produced in a rotary kiln coal gasifier according to a process as disclosed in the aforementioned patent application of P. G. Garside, the product gas supplied through conduit 16 is of a temperature of 1,800° F., a pressure of 58 psig, and flows at a rate of 47,000 pounds per hour. The unsaturated water supplied through conduit 29 is of a temperature of 250° F., and a flow rate of 21,800 pounds per hour. The preferred characteristics of the superheated steam to be generated for use in the gasification process are a temperature of 500° F., a pressure of 150 psig and a flow rate of 21,800 pounds per hour. First boiler 11 is selected to have a normal heat transfer duty of approximately 16.33 million BTU's per hour. Second boiler 13 is selected to have a normal heat transfer duty of approximately 2.76 million BTU's per hour. Economizer 14 is selected to have a normal heat transfer duty of approximately 2.30 million BTU's per hour and superheater 12 is selected to have a normal heat transfer duty of approximately 1.65 million BTU's per hour. It will be appreciated that boilers, superheaters and economizers having such capacities are well known in the art and are commercially available items forming no part of this invention.

During steady-state operation of the apparatus 10 after saturated steam flows to superheater 12 and fills coil 51, the temperatures that will be developed in the various parts of the system will be as follows (no allowance being made for friction or radiation losses). The location numbers are the reference characters of the drawing:

| LOCATION | | MEDIUM | TEMPERATURE (°F.) |
|---|---|---|---|
| Leaving | Entering | | |
| 16 | 17 | Product Gas | 1,800 |
| 19 | 20 | Product Gas | 800 |
| 22 | 23 | Product Gas | 700 |
| 25 | 26 | Product Gas | 450 |
| 28 | 27 | Product Gas | 300 |
| 29 | 30 | Unsaturated Water | 250 |
| 32 | 34 | Saturated Water | 344 |
| 36 | 37a and 37b | Saturated Water | 365 |
| 37a | 38 | Saturated Water | 365 |
| 37b | 41 | Saturated Water | 365 |
| 40 | 44 | Wet Saturated Steam | 365 |
| 43 | 45 | Wet Saturated Steam | 365 |
| 49 | 50 | Dry Saturated Steam | 365 |
| 52 | 53 | Superheated Steam | 500 |

From the foregoing detailed description of the present invention, it has been shown how the objects of the present invention have been attained in a preferred manner. However, modification and equivalents of the disclosed concepts, such as readily occur to those skilled in the art, are intended to be included in the scope of this invention. Thus, the scope of the invention is intended to be limited only by the scope of the claims, such as or may hereafter be, appended hereto.

The embodiments of the invention in which an exclusive property or privilege is claimed are defined as follows:

1. A method for the recovery of heat from a flow of a gas in a first boiler and a superheater with said gas flow initially having a temperature in excess of a predetermined safety temperature at which said superheater is susceptible to damage from thermal shock when contacted by the gas at a time when said superheater is dry; the method comprising the steps of:

(a) admitting a flow of water to said first boiler;

(b) admitting said flow of gas to said first boiler;

(c) heating said flow of water with said gas flow within said first boiler at a rate sufficient to convert said flow of water to a flow of saturated steam and reduce the temperature of said gas flow to a secondary temperature less than said safety temperature and above a temperature necessary to convert a flow of saturated steam to a flow of superheated steam within said superheater;

(d) passing said secondary temperature gas flow from said first boiler to said superheater;

(e) passing said flow of saturated steam from said first boiler to said superheater;

(f) heating said flow of saturated steam with said gas flow within said superheater at a rate sufficient to convert said flow of saturated steam to a flow of superheated steam and reduce the temperature of said gas flow to a tertiary temperature;

(g) discharging said gas flow from said superheater; and (h) discharging said flow of superheated steam from said superheater whereby the sensible heat of the gas flow is recovered to generate a flow of superheated steam and the superheater is protected from damage by the temperature of said gas flow being reduced below said safety temperature prior to being passed to said superheater at times when said superheater is dry.

2. In the method according to claim 1, wherein said tertiary temperature is sufficient to convert a flow of water to a flow of saturated steam in a second boiler;

(a) admitting a flow of water to said second boiler;

(b) admitting a flow of said tertiary temperature gas flow to said second boiler;

(c) indirectly heating said flow of water with said gas flow within said second boiler at a rate sufficient to convert said flow of water to a flow of saturated steam and reduce said temperature of said gas flow to a fourth temperature;

(d) passing said flow of saturated steam from said second boiler to said superheater; and (e) discharging said fourth temperature gas flow from said second boiler.

3. In the method according to claim 2, wherein said fourth temperature is sufficient to convert a flow of unsaturated water to a flow of saturated water within an economizer;

(a) admitting a flow of unsaturated water to said economizer;

(b) admitting a flow of said fourth temperature gas flow to said economizer;

(c) heating said flow of unsaturated water with said gas flow within said economizer at a rate sufficient to convert said flow of unsaturated water to a flow of saturated water and reduce the temperature of said gas flow to a final temperature;

(d) discharging said final temperature gas flow from said economizer; and (e) discharging said flow of saturated water from said economizer.

4. In the method according to claim 3, wherein said flow of water admitted to said first boiler is a flow of saturated water and said flow of water admitted to said second boiler is a flow of saturated water.

5. In the method according to claim 4, wherein said flow of saturated water admitted to said first boiler and said flow of saturated water admitted to said second boiler comprise said flow of saturated water passed from said economizer.

6. In the method according to claim 5, comprising drying said flow of saturated steam passed from said first boiler to said superheater and drying said flow of saturated steam passed from said second boiler to said superheater.

7. An apparatus for the recovery of heat from a flow of a gas having a first temperature in excess of a predetermined safety temperature at which a superheater is susceptible to damage from thermal shock when contacted by the gas at a time when said superheater is empty comprising, in operable combination:

(a) a first boiler operable to receive said flow of gas and flow of saturated water and further operable to indirectly heat said flow of saturated water with said flow of gas within said first boiler at a rate sufficient to convert and flow of saturated water to a flow of saturated steam and reduce the temperature of said gas flow to a secondary temperature below said safety temperature and above a temperature necessary to convert a flow of saturated steam to a flow of superheated steam within said superheater;

(b) said superheater operable to receive a flow of saturated steam and a flow of a gas of said secondary temperature and operable to indirectly heat said flow of saturated steam with said flow of secondary temperature gas within said superheater at a rate sufficient to convert said flow of saturated steam to a flow of superheated steam and reduce said temperature of said gas flow to a tertiary temperature;

(c) means for admitting a flow of said first temperature gas to said first boiler;

(d) means for supplying a flow of saturated water to said first boiler;

(e) means for passing said flow of saturated steam from said first boiler to said superheater;

(f) means for passing said flow of secondary temperature gas from said first boiler to said superheater;

(g) means for discharging said flow of superheated steam from said superheater;

(h) means for discharging said flow of tertiary temperature gas from said superheater;

(i) a second boiler operable to receive a flow of saturated water and operable to receive a flow of said tertiary temperature gas; said second boiler further operable to indirectly heat said saturated water with said flow of tertiary temperature gas within said boiler at a rate sufficient to convert said saturated water to saturated steam and reduce the temperature of said gas flow to a fourth temperature;

(j) means for admitting to said second boiler said flow of tertiary temperature gas discharged from said superheater;

(k) means for supplying to said second boiler a flow of saturated water;

(l) means for passing said flow of saturated steam from said second boiler to said superheater;

(m) means for discharging said flow of fourth temperature gas from said second boiler; and (n) means intermediate said first boiler and said superheater and intermediate said second boiler and said superheater for drying said flows of saturated steam.

8. An apparatus according to claim 7 comprising:

(a) an economizer operable to receive a flow of said fourth temperature gas and operable to receive a flow of unsaturated water; said economizer further operable to indirectly heat said flow of unsaturated water with said flow of fourth temperature gas within said economizer at a rate sufficient to convert said flow of unsaturated water to a flow of saturated water and reduce the temperature of said flow of gas to a final temperature;

(b) means for supplying a flow of unsaturated water to said economizer;

(c) means for admitting to said economizer said flow of fourth temperature gas discharged from said second boiler;

(d) means for discharging said flow of final temperature gas from said economizer; and (e) means for discharging said flow of saturated water from said economizer.

9. An apparatus according to claim 8 comprising:

(a) means for dividing said flow of saturated water discharged from said economizer into a first flow and a second flow;

(b) means for passing said first flow to said first boiler; and (c) means for passing said second flow to said second boiler.

* * * * *